US009637362B2

(12) United States Patent
Zhang

(10) Patent No.: US 9,637,362 B2
(45) Date of Patent: May 2, 2017

(54) JACK FOR LIFTING SMALL UTILITY VEHICLES

(71) Applicant: Allen Zhang, Chino, CA (US)

(72) Inventor: Allen Zhang, Chino, CA (US)

(73) Assignee: Larin Corporation, Chino, CA (US)

( * ) Notice: Subject to any disclaimer, the term of this patent is extended or adjusted under 35 U.S.C. 154(b) by 179 days.

(21) Appl. No.: 13/927,380

(22) Filed: Jun. 26, 2013

(65) Prior Publication Data

US 2015/0001453 A1 Jan. 1, 2015

(51) Int. Cl.

| | |
|---|---|
| ***B66F 1/06*** | (2006.01) |
| ***B66F 5/02*** | (2006.01) |
| ***B66F 7/18*** | (2006.01) |
| ***B66F 7/28*** | (2006.01) |

(52) U.S. Cl.

CPC ..... *B66F 5/02* (2013.01); *B66F 1/06* (2013.01); *B66F 7/18* (2013.01); *B66F 7/28* (2013.01)

(58) Field of Classification Search

CPC ..... B62B 3/00; B62B 3/0606; B62B 3/0618; B62B 3/0625; B62B 5/087; B66F 9/06; B66F 7/00; B66F 7/02

USPC ..... 254/2 C, 4 B, 4 R, 6 R, 8 B, 8 R, 10 B; 269/17

See application file for complete search history.

(56) References Cited

U.S. PATENT DOCUMENTS

| | | | | |
|---|---|---|---|---|
| 2,786,650 | A * | 3/1957 | Bottorff | 254/134 |
| 2,947,513 | A * | 8/1960 | Nolden et al. | 254/2 B |
| 3,044,747 | A * | 7/1962 | Nolden | 254/2 B |
| 3,091,431 | A * | 5/1963 | Arnes et al. | 254/2 B |
| 3,215,402 | A * | 11/1965 | Hott | B66F 7/025 254/7 B |
| 3,225,868 | A * | 12/1965 | Barnes | B62B 1/14 187/231 |
| 3,391,905 | A * | 7/1968 | Burns | B62B 3/0625 212/901 |
| 3,582,043 | A * | 6/1971 | Tranchero | 254/2 R |
| 3,749,361 | A * | 7/1973 | Johnson | 254/2 R |
| 4,479,634 | A * | 10/1984 | Blatz | B66F 7/10 248/354.5 |
| 5,090,667 | A * | 2/1992 | Harrell | 254/326 |
| 5,338,015 | A * | 8/1994 | Liegel et al. | 269/71 |
| 5,358,217 | A * | 10/1994 | Dach | 254/2 R |
| 5,975,826 | A * | 11/1999 | Scholder | 414/444 |
| 6,050,548 | A * | 4/2000 | Leger | 254/326 |
| 6,551,050 | B1 * | 4/2003 | Kallevig et al. | 414/607 |
| 7,111,444 | B1 * | 9/2006 | Morris et al. | 56/15.9 |
| 7,810,799 | B2 * | 10/2010 | McGloghlon | 269/17 |
| 8,141,850 | B2 * | 3/2012 | Drake | 254/4 B |
| 8,387,953 | B2 * | 3/2013 | Drake | 254/112 |
| 8,469,338 | B2 * | 6/2013 | Gann et al. | 254/1 |

(Continued)

*Primary Examiner* — Joseph J Hail
*Assistant Examiner* — Jon Taylor
(74) *Attorney, Agent, or Firm* — Fisher Broyles, LLP; Rob L. Phillips

(57) ABSTRACT

A jack for lifting a small wheeled utility vehicle such as a lawn mower. The jack includes spaced bars having a lever actuated jacking mechanism therebetween. A base cross bar is carried by the jacking mechanism up and down the same and has spaced cradles for receiving the wheels of the utility vehicle therein. The spacings between the cradles and within the cradles are adjustable for adapting to the wheels of the vehicle. The jack also includes a base bar extending away from the bars for stabilizing the same and movable to a stored position.

6 Claims, 10 Drawing Sheets

(56) References Cited

U.S. PATENT DOCUMENTS

| | | | | |
|---|---|---|---|---|
| 8,974,169 | B2 * | 3/2015 | Mizner | 414/462 |
| 2002/0134970 | A1 * | 9/2002 | Bressner et al. | 254/4 R |
| 2006/0278855 | A1 * | 12/2006 | Krug | 254/4 B |
| 2010/0283016 | A1 * | 11/2010 | Drake | 254/99 |
| 2011/0181022 | A1 * | 7/2011 | Gries | 280/511 |
| 2013/0228729 | A1 * | 9/2013 | Elliott et al. | 254/2 |

* cited by examiner

JACK FOR LIFTING SMALL UTILITY VEHICLES

BACKGROUND OF THE INVENTION

1. Field

This invention relates to lifting jacks, and, more particularly to a mobile jack for lifting mobile small utility vehicles, such as golf carts, riding lawn mowers, ATVs, etc.

2. Description of Related Art Including Information Disclosed Under 37 CFR 1.97 and CFR 1.98

Prior art devices are known for lifting wheeled vehicles such as lawn mowers for servicing and cleaning, such as self-propelled riding type lawn mowers or lawn tractors. This type of lawn mowing equipment is quite heavy and cannot be easily lifted which is often required in the servicing for cleaning, blade replacement or sharpening.

Heretofore it was necessary to manually lift the front end of the mower or tractor up onto temporary service blocks to provide sufficient clearance for access under the mowing deck of the equipment.

In recent years, such small tractors, riding lawn mowers and similar vehicles, having a power capacity in the order of roughly 5-25 hp, have been widely sold for such purposes as the cutting of lawns, tilling the soil, plowing snow, hauling and other tasks around the home or farm. Like all mechanical equipment, these vehicles require servicing such as the removal of rotary blades for sharpening or replacement, periodic lubrication and/or oil changes, etc. It is often times inconvenient and always expensive to have such maintenance performed at a central service facility having the necessary lifts to elevate the vehicle bodily for performing these operations since the vehicle must be loaded onto some type of carrier and transported to the facility, and delays in the completion of such servicing are common. Many of these servicing operations are of the type that can be performed by the average owner and indeed many owners would prefer to do this work themselves in order to save time and money and, moreover, insure themselves of satisfactory execution.

However, many maintenance procedures require that at least one end of the lawn mower or tractor be elevated at least about one food and often somewhat higher above the ground so that the operator can have access to the undercarriage of the vehicle where the mower blade is often situated or the lubrication fittings located. Despite their relatively small size and capacity, these vehicles nevertheless have a considerable weight which typically exceeds the lifting strength of the average person. Of course, conventional jacks of the type used for jacking automobiles and the like could be employed, but as is well known by those familiar with automotive mechanics, these jacks are not sufficiently stable in operation to permit work to be safely performed beneath the vehicle suspended therefrom, but must be used together with jack stands; but since each side of an end of the tractor must be jacked separately and then placed on a separate jack stand for stable elevation, this is inconvenient and time consuming.

Various kinds of portable jacks have been suggested for various purposes, but none of these are well suited for the function described above.

BRIEF SUMMARY OF THE INVENTION

It is an object of this invention to provide a lifting jack for lifting a small wheeled utility vehicle such as a lawn mower for servicing the same.

It is another object of this invention to provide such a lifting jack which firmly anchors the lawn mower to the jack prior to lifting the same.

These and other objects are preferably accomplished by providing a jack that has provisions for locking the front wheels of the lawn mower in secure position. The jack is easy to operate by actuation of a lever to raise and lower the lawn mower.

DESCRIPTION OF PREFERRED EMBODIMENT

Figure 1:
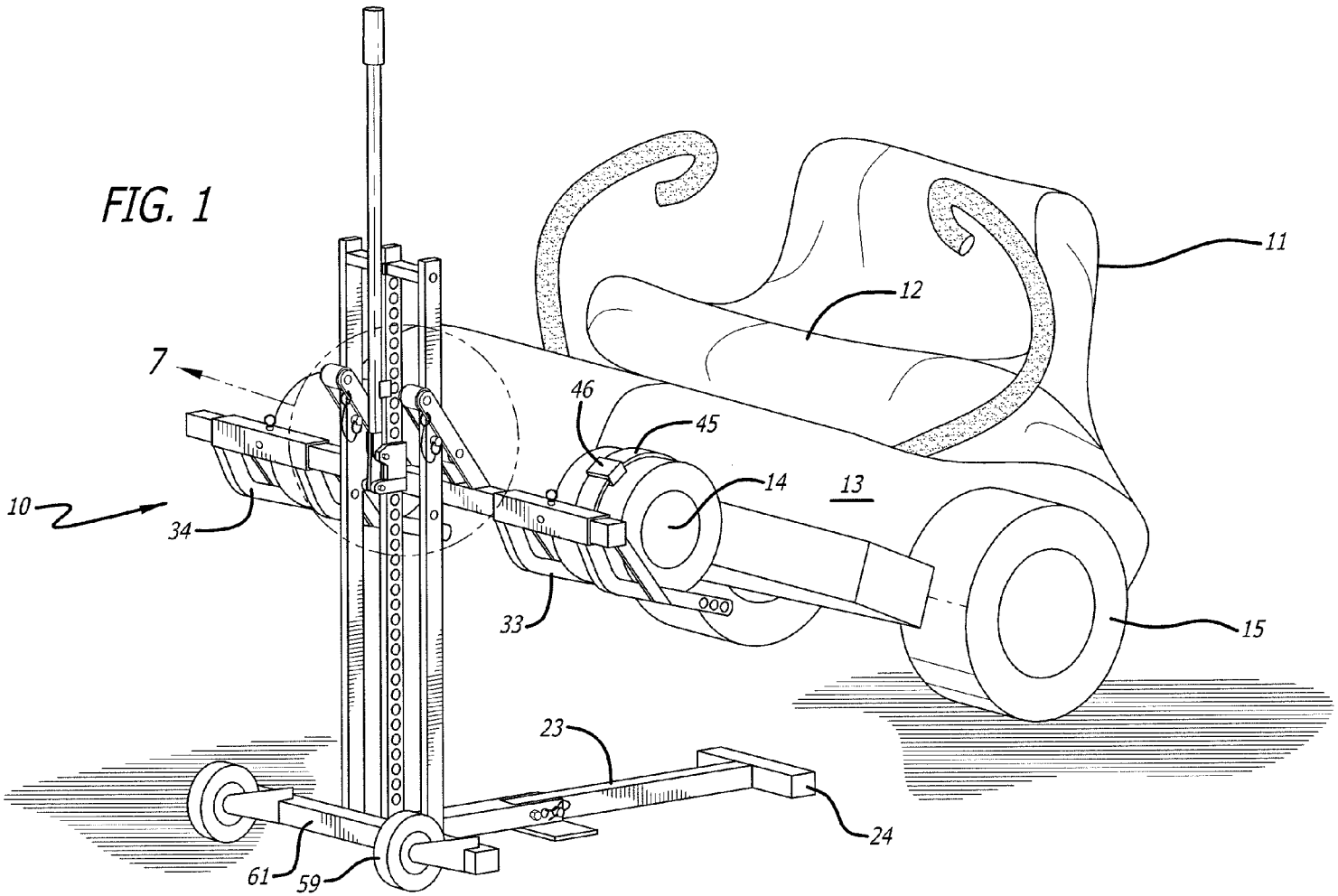
FIG. 1 is a perspective view of the jack of the invention illustrating lifting of a wheeled lawn mower.

Referring now to FIG. 1 of the invention, a jack 10 is shown lifting a wheeled lawn mower 11 for servicing the same. Lawn mower 11 is a conventional lawn mower having a driver's seat 12 and a chassis 13 with front and rear wheels 14, 15, respectively.

Figure 2:
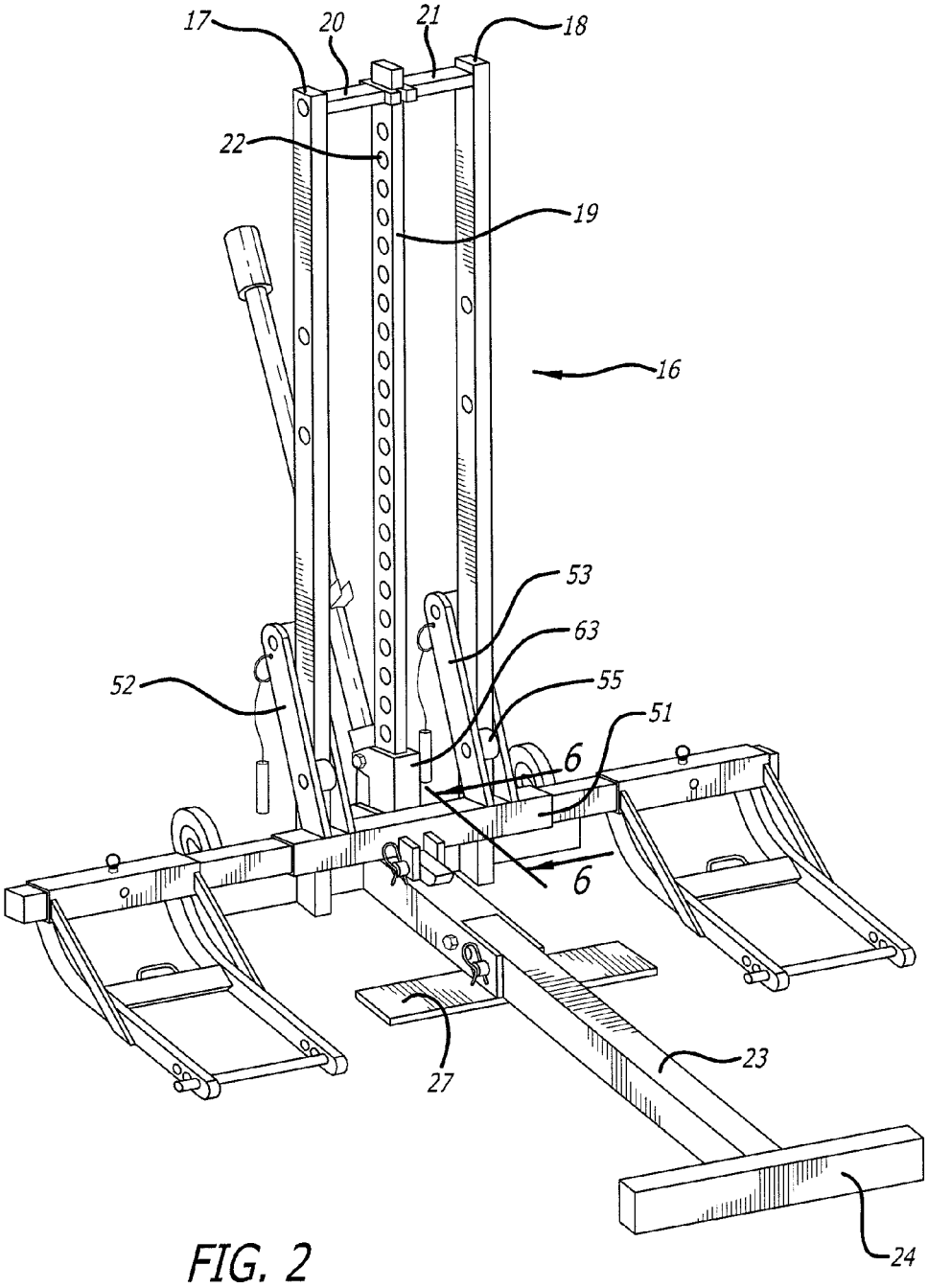
FIG. 2 is a front elevational view of the jack alone of FIG. 1.

Jack 10 is shown in FIG. 2 having a framework 16 comprising spaced vertically extending bars 17, 18, which are interconnected at top to a centrally located vertically extending bar 19 interconnected to bars 17, 18 by interconnecting bars 20, 21, respectively. Bar 19 has a plurality of vertically extending spaced holes 22 for reasons to be discussed.

Figure 4:
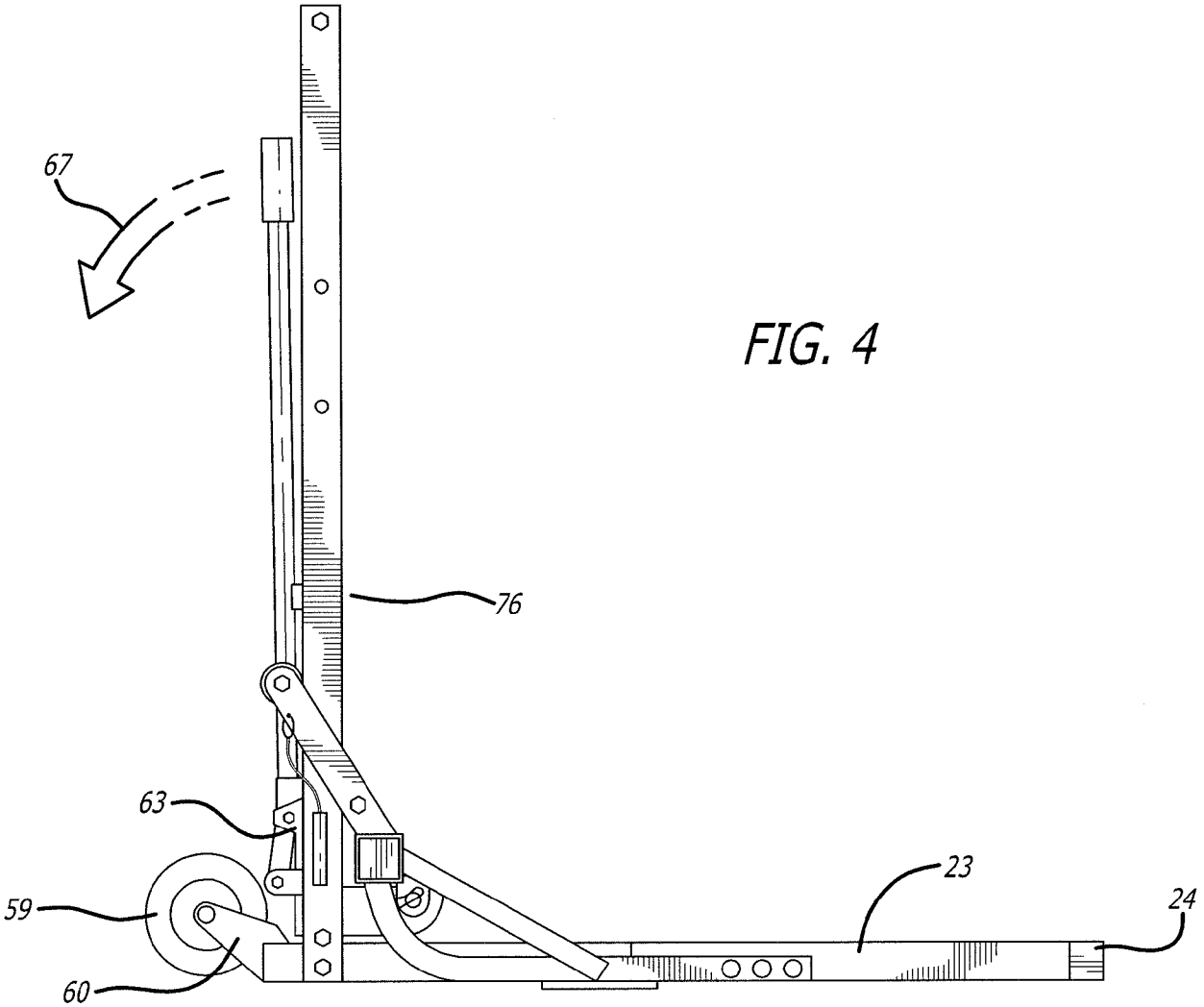
FIG. 4 is a side elevational view of the jack of FIG. 2.
Figure 9:
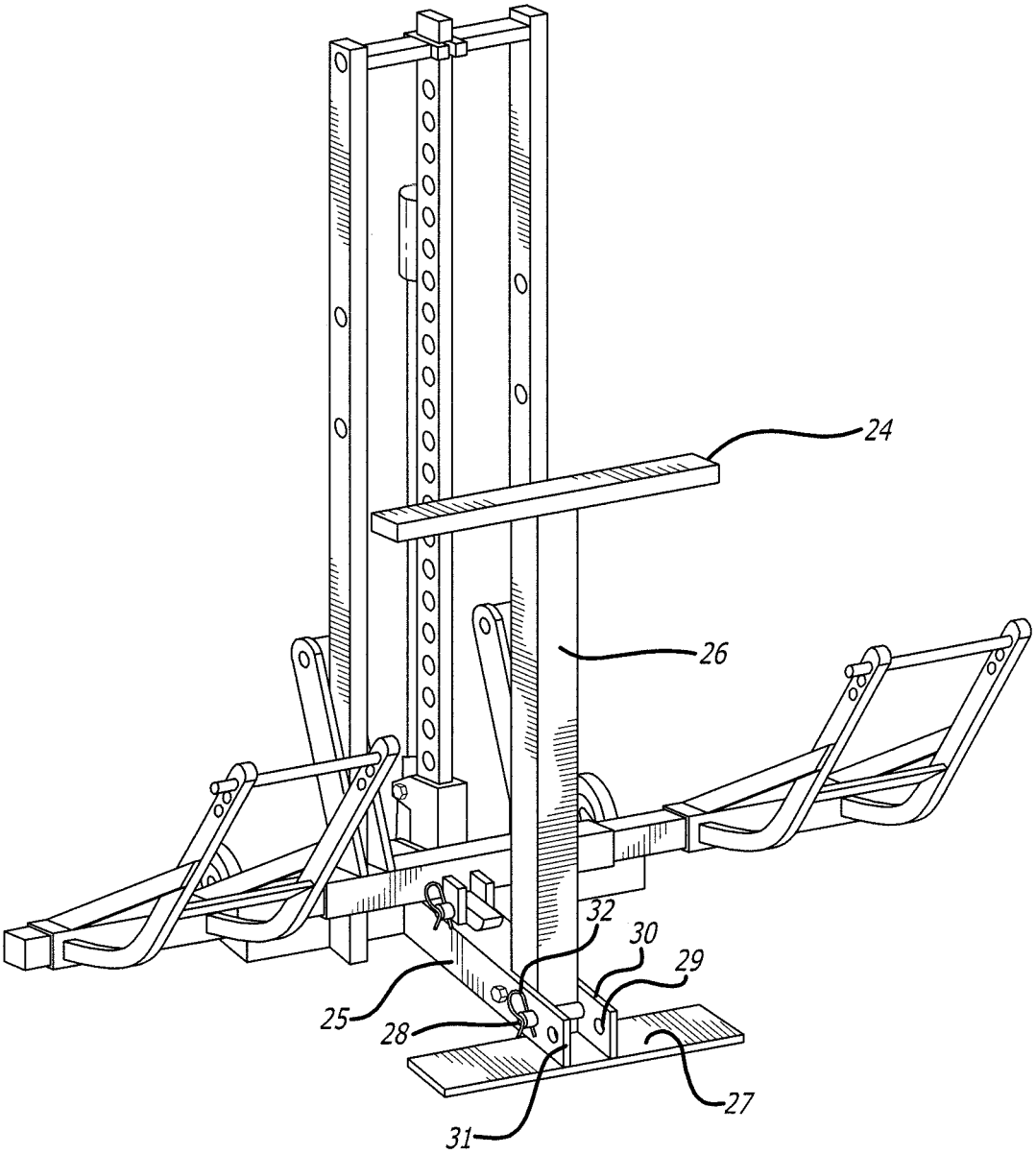
FIG. 9 is a side perspective view of the jack alone of FIG. 1.

Upright bars 17, 18 are secured at bottom to a base bar 23 (see particularly FIG. 4) extending toward lawn mower 10 (FIG. 1) and terminating in a cross bar 24 (FIG. 1). Base bar 23 is comprised of 2 interconnected sections 25, 26 as best seen in FIG. 9. A flat support plate 27 is secured to section 25 and section 26 pivots between U-shaped section 25 as shown. A locking pin 28 is inserted into aligned holes 29 in the upstanding spaced walls 30, 31 to hold section 26 in the position shown in FIG. 9 for storage. A clip 32 holds pin 28 in fixed position. Thus, as seen in FIG. 2, base bar 23, plate 27 and cross bar 24 support the framework 16 in the position shown in FIG. 2 but can be quickly and easily folded up for storage to the FIG. 9 position.

Figure 3:
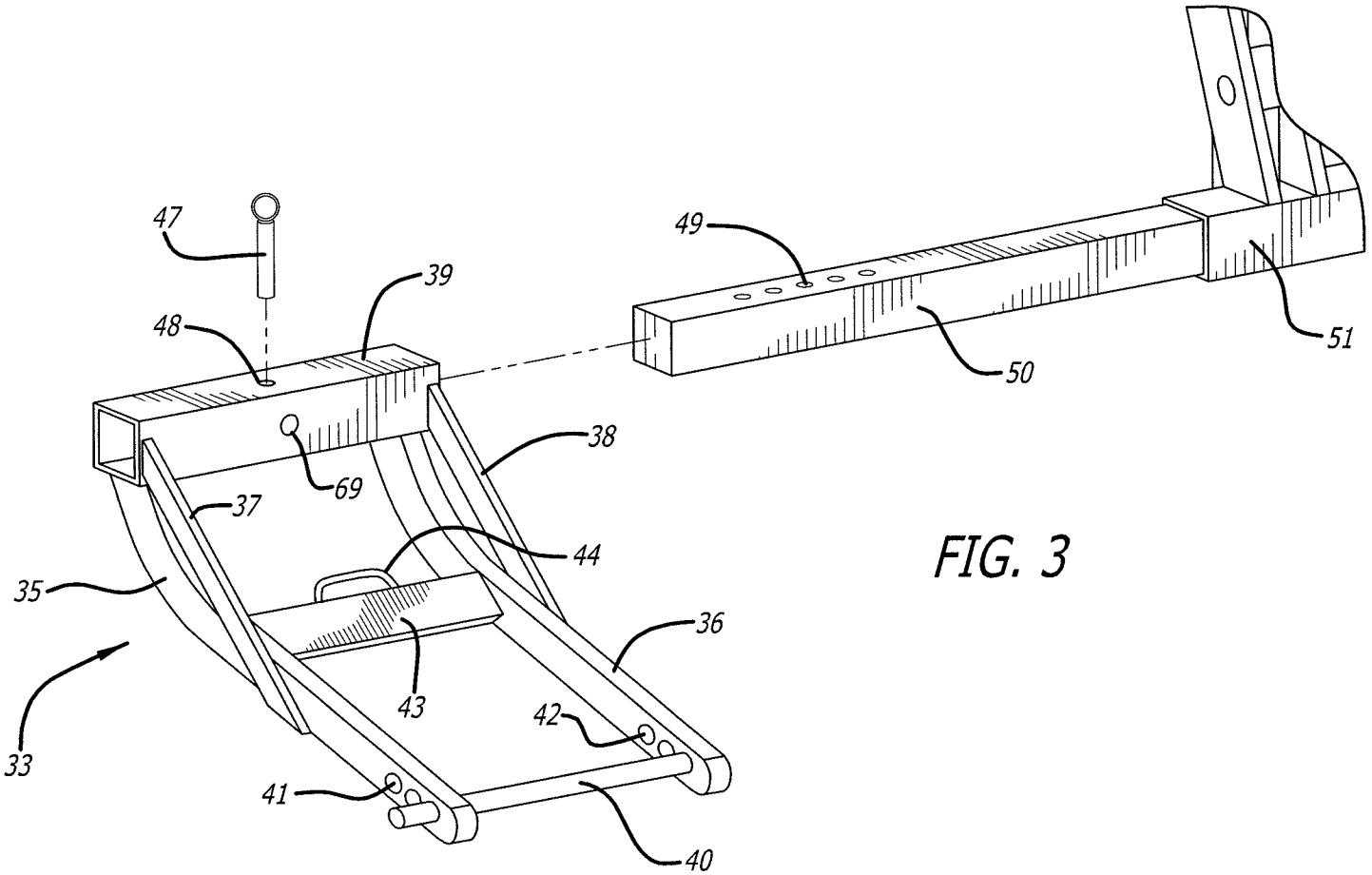
FIG. 3 is an exploded view illustrating the assembly of a width adjusting bar to the framework of the jack of FIGS. 1 and 2.

The front wheels 14 of lawn mower 11 (FIG. 1) are supported in spaced cradles 33, 34. Each cradle 33, 34 (see particularly cradle 33 in FIG. 3) includes spaced curved brackets 35, 36 interconnected by support bars 37, 38 to a tubing 39 as by welding or the like. Tubing 39 may be hollow and square shaped as shown in FIG. 3.

Brackets 35, 36 are interconnected at front by a tubular support 40 receivable in selective ones of aligned spaced holes 41, 42 in the terminal ends of cradles 33, 34, respectively, for adjusting the spacing between cradles 35, 36, rod 40, and cross plate 43 extending between cradles 33, 34 and secured thereto in any suitable manner, such as by welding. A U-shaped bracket 44 is provided at the top of cross plate 43 for securing a strap 45 and buckle 46 thereto for firmly holding wheels 14 in position on jack 10 (see FIG. 1).

The spacing between cradles 35, 36 is adjustable by selectively inserting pin 47 in a hole 48 in tubing 39 and into one of the spaced holes 49 in cross bar 50. Bar 50 is telescopingly receivable inside of tubing 39.

Cross bar 50 extends through a bar 51 (FIG. 2) having a pair of spaced brackets 52, 53 (FIG. 7) welded thereto. Each bracket 52, 53 is comprised of spaced flanges interconnected at top by rollers 54.

Bars 17, 18 extend between brackets 52, 53 and pins 55 (see also FIG. 2) interconnecting the spaced flanges of each bracket 52, 53.

Figure 7:
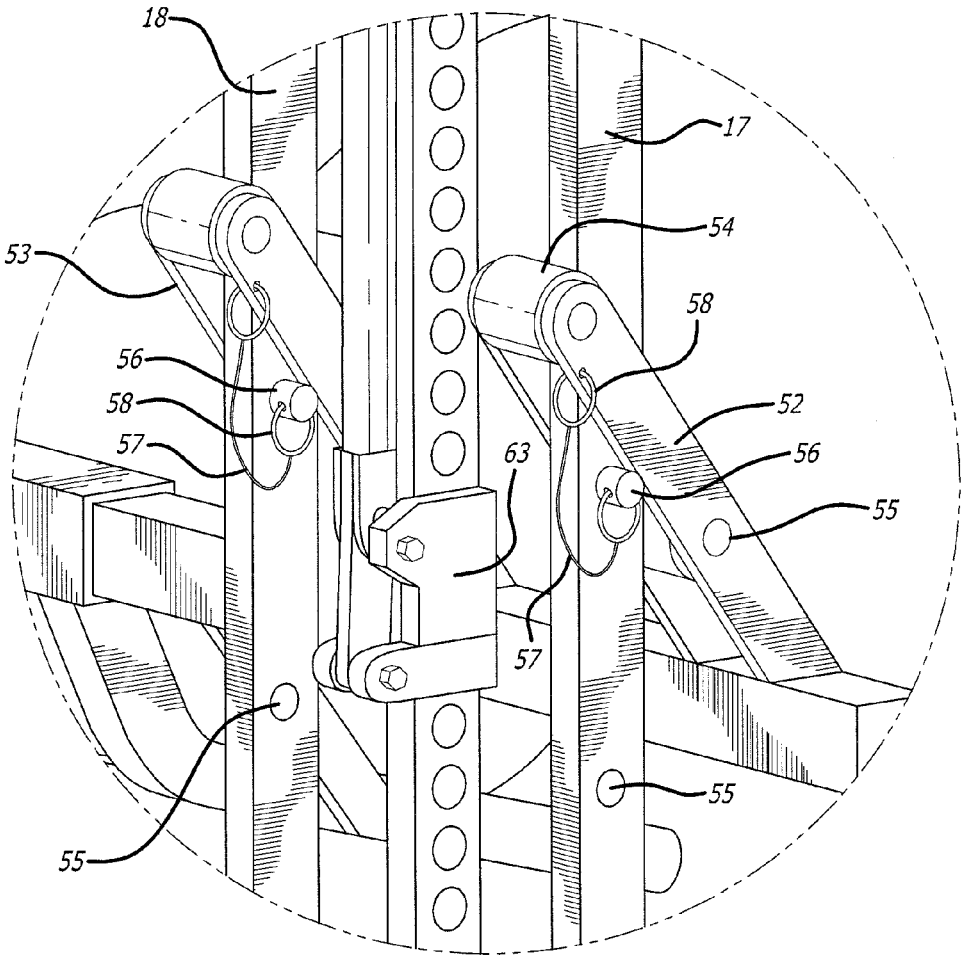
FIG. 7 is a view of the jack of FIG. 1 taken along line 7 of FIG. 1.

As cross bar 50 moves up and down on jack 10, brackets 52, 53 may be prevented from moving downwardly by selectively aligned holes 55 (see also FIG. 5) in bars 17, 18 and locking pins 56 mounted therein (FIG. 7). Pins 56 are secured to each bracket 52, 53 by wires 57 attached to both pins 56 and ring 58 secured to brackets 52, 53.

Spaced wheels 59 are rotatably mounted at the bottom of framework 16 (see FIG. 4) by brackets 60 secured to cross bar 61 (see FIG. 1) welded or the like to the bottom of bars 17, 18 so that jack 10 can be easily wheeled from one location to the other.

Figure 5:
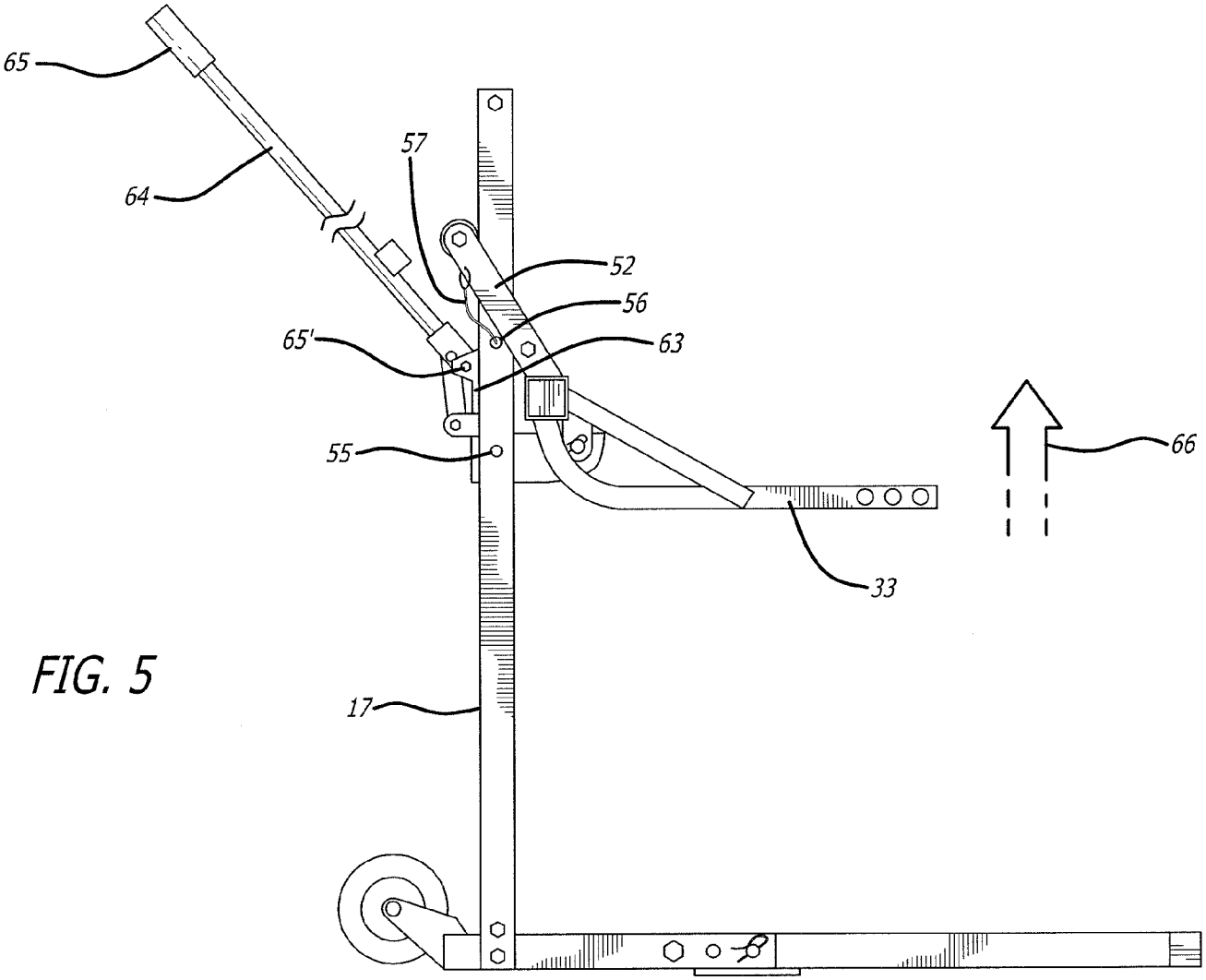
FIG. 5 is a view similar to FIG. 4 illustrating the raising of the lawn mower lifting portions of the jack of FIG. 4.
Figure 6:
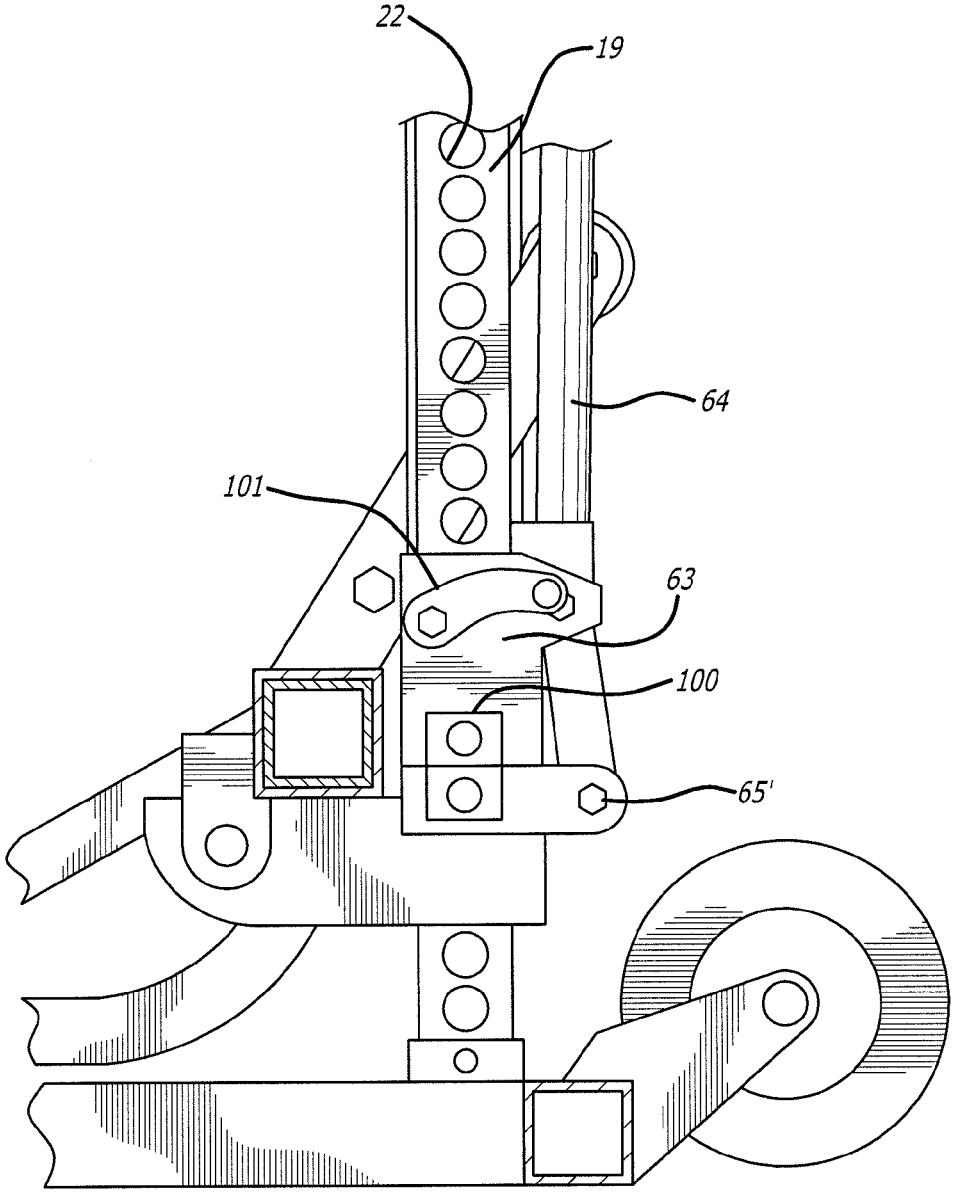
FIG. 6 is a detailed view, partly in cross-section, of a portion of the jack alone of FIG. 1.
Figure 8:
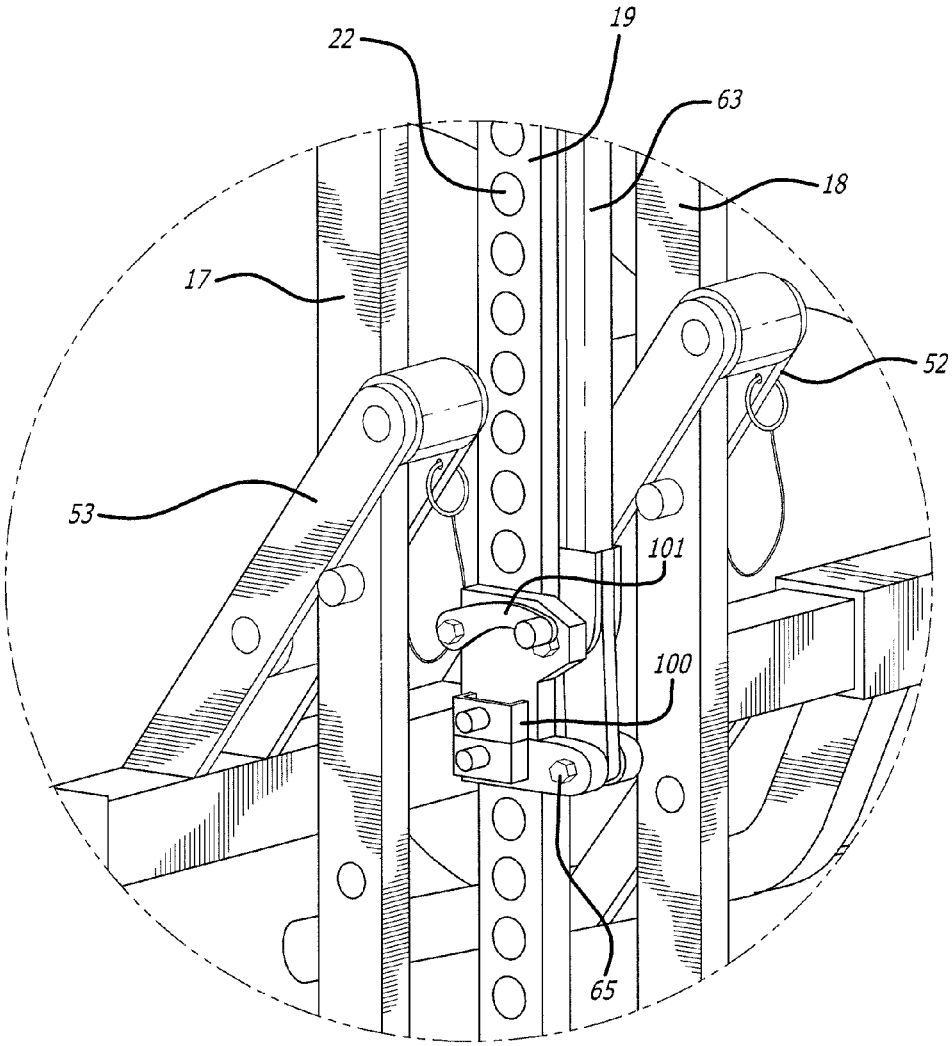
FIG. 8 is a view similar to FIG. 7 taken in the opposite direction from FIG. 7.

Bar 51 (FIG. 2) is secured as by welding, or the like, to a housing 63 through which center bar 19 extends. Housing 63 is selectively movable up and down bar 19 by jacking the same as is well known in the art. Thus, as seen in FIGS. 5, 6 and 8, a level 64 having a handle grip 65 at top, is connected to housing 63 by pivot pin 65.

Housing 63 includes ratcheting mechanism having ratchet means 100 (FIGS. 6 and 8) adapted to selectively engaged spaced holes 22 (see also FIG. 1) in center bar 19 so as to selectively raise and lower housing 63 along bar 19 as is well known in the art. Thus, pivoting lever 64 raises housing 63 upwardly on bar 19 in the direction of arrow 66 (FIG. 5) thereby raising cradles 33, 34. Brackets 52, 53 (FIG. 7) are locked in position using wires 57, and pins 56 and rings 58 so that, should jack 10 fail for any reason, housing 63 cannot slide down. Arcute bracket 101 (FIGS. 6 and 8) may be moved downwardly to reverse the ratcheting of the mechanism all as is well known in the art.

In operation, the wheels 14, 15 of lawn mower 11 are rolled onto cradles 33, 34. The spacing between plates 43, rod 40 and brackets 35, 36 are adjusted as theretofore discussed to provide for the width and diameter of wheels 14, 15 as discussed.

Straps 45 and buckles 46 are adjusted using brackets 44 to secure the wheels 14, 15 and thus lawn mower 11, in position.

The spacing between the wheels 14, 15 is also adjusted by adjustment of tubing 39 on cross bar 50 also as previously discussed.

Lever 64 is now activated by moving it in the direction of arrow 67 (FIG. 4) which raises bracket housing 63 thus raising lawn mower 11 upwardly in the direction of arrow 66 as seen in FIG. 5. Thus, lawn mower 11 can be serviced or the like.

Straps 45 and buckles 56 can be untied when the lawn mower 11 is down and it can be wheeled away. Pins 47 (FIG. 3) can be removed and tubing 39 rotated so holes 69 are aligned with a hole 49 in cross bar 50 with pin 47 then inserted into the aligned holes. This rotates cradles 35, 34 to the stored position shown in FIG. 10.

Section 26 is rotated to the upright position shown in FIG. 9 as previously discussed. Lever 64 is rotated back to the stored position shown in FIG. 4.

Figure 10:
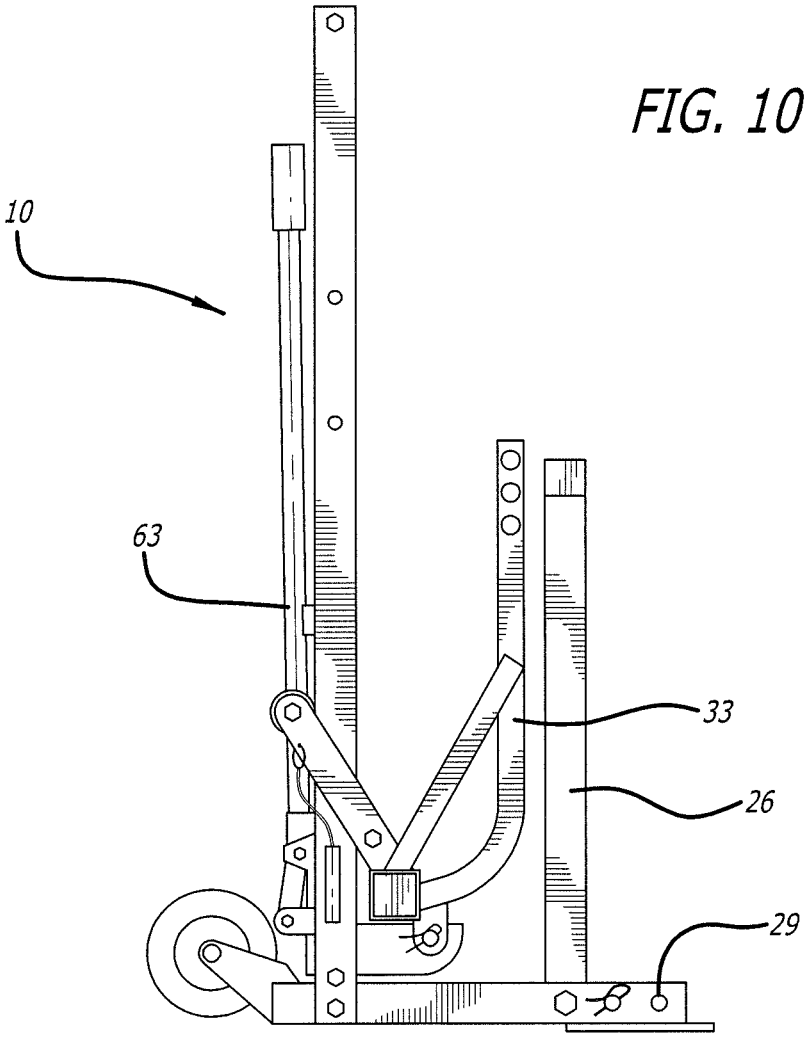
FIG. 10 is a side elevational view of the jack alone of FIG. 1 shown in stored folded position.

The final stored position of jack 10 is shown in FIG. 10. The section 26 of base bar 23 is shown in the upright position and cradles 33, 34 are also upright as is lever 64 as seen in FIG. 10, the pin 28 being inserted into a hole 29 closer to framework 16. The jack 10 may now be wheeled to any suitable location for storage.

It can be seen that there is discussed a jack that can be used to quickly and easily lift a wheeled mobile device such as a lawn mower for servicing the same. It can be folded for storage until needed.

Although particular embodiment of the investment is disclosed, the invention is not limited to the above embodiment and various modifications thereof may be made. Further, various changes to form and detail may be made without departing from the scope of the invention.

The invention claimed is:

1. A jack for lifting wheeled mobile devices consisting of:

a two wheeled framework; said framework including:

a. a base plate, b. a pair of spaced fixed height upright vertically extending bars connected to said base plate, and c. an apertured center bar of fixed height and not being movable up or down disposed between said upright bars of fixed height and not being movable up or down, and the top of the apertured center bar and top of each of the upright bars are connected and fixed with a cross member located at the top of the center bar and top of each of the upright bars to thereby form a rigid fixed structure;

a ratcheting mechanism having said center bar receivable therein, said ratcheting mechanism having d. a ratchet housing movable up and down said center bar selectively engaging said apertures in said center bar and e. a pivotable lever coupled to said ratchet housing for selectively moving said ratchet housing up and down said center bar when rotated;

a cross bar mounted on said framework secured to said ratchet housing such that as the ratchet mechanism moves up and down on the center bar, said cross bar having f. a pair of cradles mounted on opposite ends thereof, the spacing between said cradles being adjustable;

a base bar mounted at the bottom of said framework extending in the direction of said cradles, said base bar having g. a support plate for supporting said framework on a supporting surface and terminating in a cross bar remote from said cradles, wherein said base bar comprises a pair of pivotally connected sections, one section terminating in said cross bar and pivotable upwardly towards said vertically extending bars to a position generally parallel to said vertically extending bars and locked to said other section for storing the same, and the spaced upright vertically extending bars including locks for operation with the cross bar mounted on the framework whereby the cross bar is lockable to the vertically extending fixed bars to prevent movement downwardly of the cross bar mounted on the framework, wherein the locks include a pair of brackets, each bracket being separated from the other without an intervening connector and being directly connected with the cross bar, and each bracket being directed from the cross bar rearwardly and upwardly at an angle to a position behind the vertical bars such that an end of the bracket behind the vertical bar includes a transverse roller for engaging behind the bar and a lower-positioned roller in front of the bar for engaging the vertically extending fixed height bars, including spaced apertures in the fixed height vertical bars, and pins for extending through the apertures below the brackets and whereby the brackets rest on the pins thereby to secure the brackets from downward movement, and wherein the pins are selectively removable from the apertures and are selectively locatable in a selected spaced aperture thereby to secure the cross bar in a selected height position.

2. The jack of claim 1 wherein each of said cradles comprises a pair of spaced arcuate brackets interconnected by a cross plate adjacent said cross bar mounted on the framework and terminating away from said cross bar mounted on the framework in a rod connected to said arcuate brackets, and said arcuate brackets having a plurality of spaced aligned holes in each arcuate bracket for receiving said rod.

3. The jack of claim 2 wherein each of said cradles has a U-shaped clip thereon for attaching a strap thereto.

4. The jack of claim 1 including an adjustment structure wherein said cradles are adjustable by the structure on said cross bar mounted on the framework, the adjustment structure including hollow tubing receiving said cross bar therein, said cross bar having spaced holes and said tubing having at least one hole aligned with one of said holes in said cross bar mounted on the framework for selectively receiving a locking pin therein.

5. The jack of claim 4 wherein said cross bar and said tubing are square shaped, each of said cradles includes a second hole in said tubing on a side wall thereof adjacent where said first hole in said tubing is located so that said tubing can be rotated to a second position on said cross bar and said locking pin can be inserted into said second hole and into an aligned hole in said cross bar thereby holding said cradles to an upright locked position.

6. The jack of claim 1 wherein each lock bracket includes an extension ahead of the front roller, the cross bar being connected of the end of the extension thereby to retain the cross bar separated and removed from the vertical bars.

* * * * *